US006336692B1

(12) United States Patent
Snyder

(10) Patent No.: US 6,336,692 B1
(45) Date of Patent: Jan. 8, 2002

(54) CABINET WITH DOWNWARD EXTENDABLE/RETRACTABLE SHELVES

(76) Inventor: David E. Snyder, 3602 W. Behrend Dr., Glendale, AZ (US) 85308

( * ) Notice: Subject to any disclaimer, the term of this patent is extended or adjusted under 35 U.S.C. 154(b) by 0 days.

(21) Appl. No.: 09/318,160

(22) Filed: May 25, 1999

(51) Int. Cl.[7] ..... A47B 51/00
(52) U.S. Cl. ..... 312/312; 312/306
(58) Field of Search ..... 312/306, 312, 312/550, 319.1, 246, 247, 319.5, 319.8

(56) References Cited

U.S. PATENT DOCUMENTS 1,425,259 A * 8/1922 Howe ..... 312/312
1,462,271 A * 7/1923 Ennis ..... 312/312 X
2,382,354 A * 8/1945 Wales ..... 312/312 X
2,944,540 A * 7/1960 Littell, Jr. ..... 312/312
3,415,586 A * 12/1968 Hammond ..... 312/306
4,942,328 A * 7/1990 Price ..... 312/306
5,450,800 A * 9/1995 Leonard ..... 312/319.8 X

* cited by examiner

*Primary Examiner*—Peter M. Cuomo
*Assistant Examiner*—Stephen Vu
(74) *Attorney, Agent, or Firm*—Jeffrey Weiss; Jeffrey D. Moy; Weiss & Moy, P.C.

(57) ABSTRACT

A cabinet for mounting to a wall or ceiling with downward extendable and retractable shelving assembly is provided. The cabinet includes a housing having an open bottom. Disposed within the housing is a shelving assembly having a plurality of shelves. A novel combination of a tension gas spring and telescoping drawer glides are used for mounting the shelving assembly to the housing. When items are needed from the cabinet, the shelving is pulled down until all the shelves are exposed. When access is no longer needed, a light tap to the bottom of the shelving assembly causes the tension gas spring to smoothly retract the shelving assembly back into the housing.

12 Claims, 5 Drawing Sheets

CABINET WITH DOWNWARD EXTENDABLE/RETRACTABLE SHELVES

TECHNICAL FIELD

The present invention relates to cabinets and in particular to a cabinet mountable to a ceiling or wall having shelving assembly that are downwardly extendable and retractable.

BACKGROUND OF THE INVENTION

Conventional cabinets of the type that are usually found mounted to walls have a front panel with doors that open to permit access to the interior of the cabinet. Disposed in the interior are usually a plurality of shelves starting from the lowest shelf to the highest. A disadvantage to these types of cabinets is that the accessibility to the top shelves and in particular the rear portion of the top shelves, can be difficult. Oftentimes, stools or ladders must be used to reach these shelves. Using stools and ladders not only creates the risk of falling, but may not be practical where space is limited. For a physically challenged person, such as a person confined to a wheelchair, access to the top shelves is even more difficult.

Accordingly, a need exists for a wall or ceiling mountable cabinet where all the shelves are easily accessible without the need for a ladder or stool.

SUMMARY OF THE INVENTION

An object of the present invention is to provide a wall or ceiling mountable cabinet where all the shelves are easily accessible.

Another object of the present invention is to provide a wall or ceiling mountable cabinet having shelves easily accessible to a person who is physically challenged.

The present invention accomplishes these objects by providing a cabinet having a shelving assembly that can be extended downward when access is required and then retracted upward when access is no longer required. The cabinet includes a housing having an open bottom. Disposed within the housing is a shelving assembly having a plurality of shelves. A novel combination of a tension gas spring and telescoping drawer glides are used for mounting the shelving assembly to the housing. When items are needed from the cabinet, the shelving is pulled down until all the shelves are exposed. When access is no longer needed, a light tap to the bottom of the shelving assembly causes the tension gas spring to smoothly retract the shelving assembly back into the housing.

These and other objects, features and advantages of the present invention are specifically set forth in or will become apparent from the following detailed description of a preferred embodiment of the invention when read in conjunction with the accompanying drawings.

DESCRIPTION OF THE PREFERRED EMBODIMENT

Figure 1:
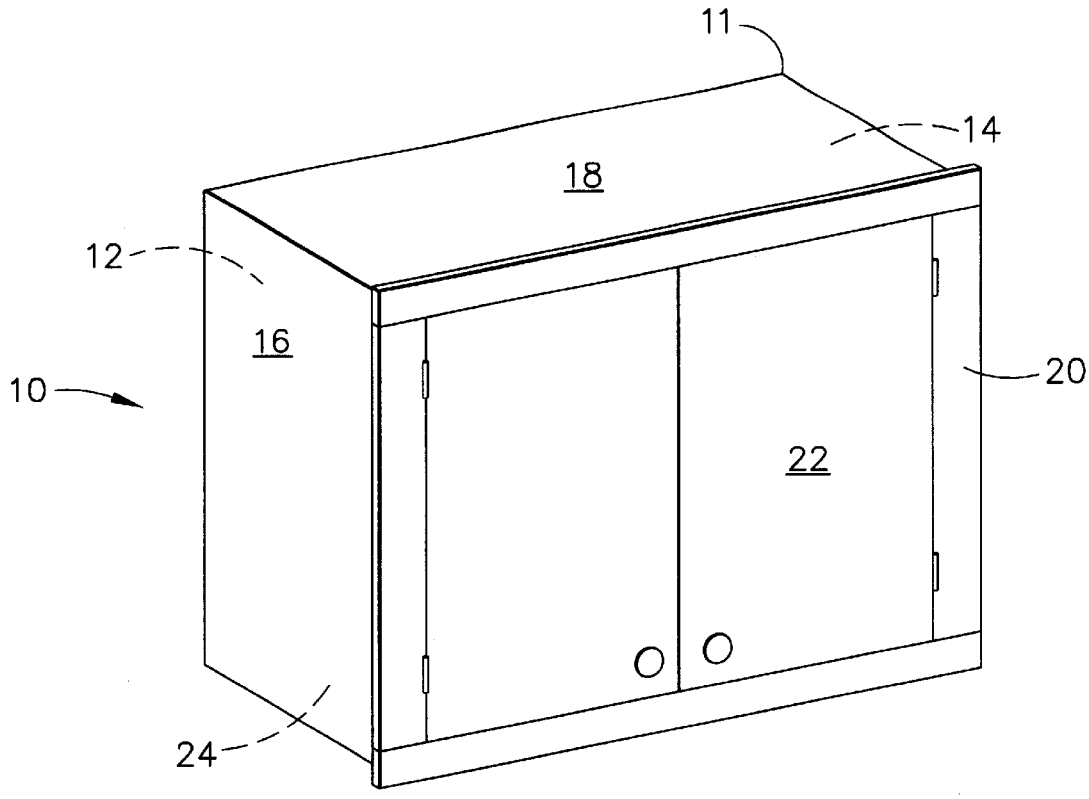
FIG. 1 is a perspective view of a wall or ceiling mountable cabinet contemplated by the present invention.
Figure 2:
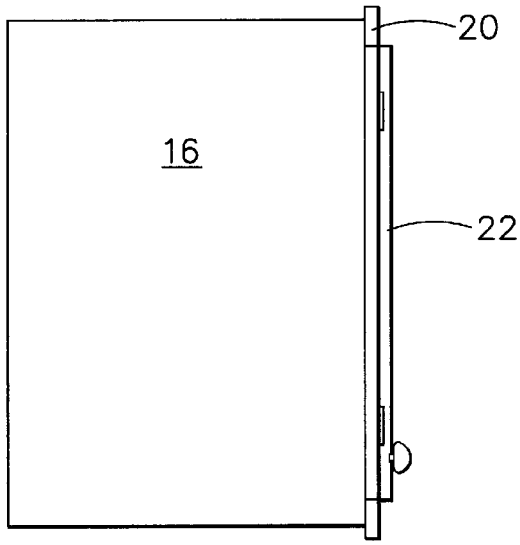
FIG. 2 is a side view of the cabinet of FIG. 1.
Figure 5:
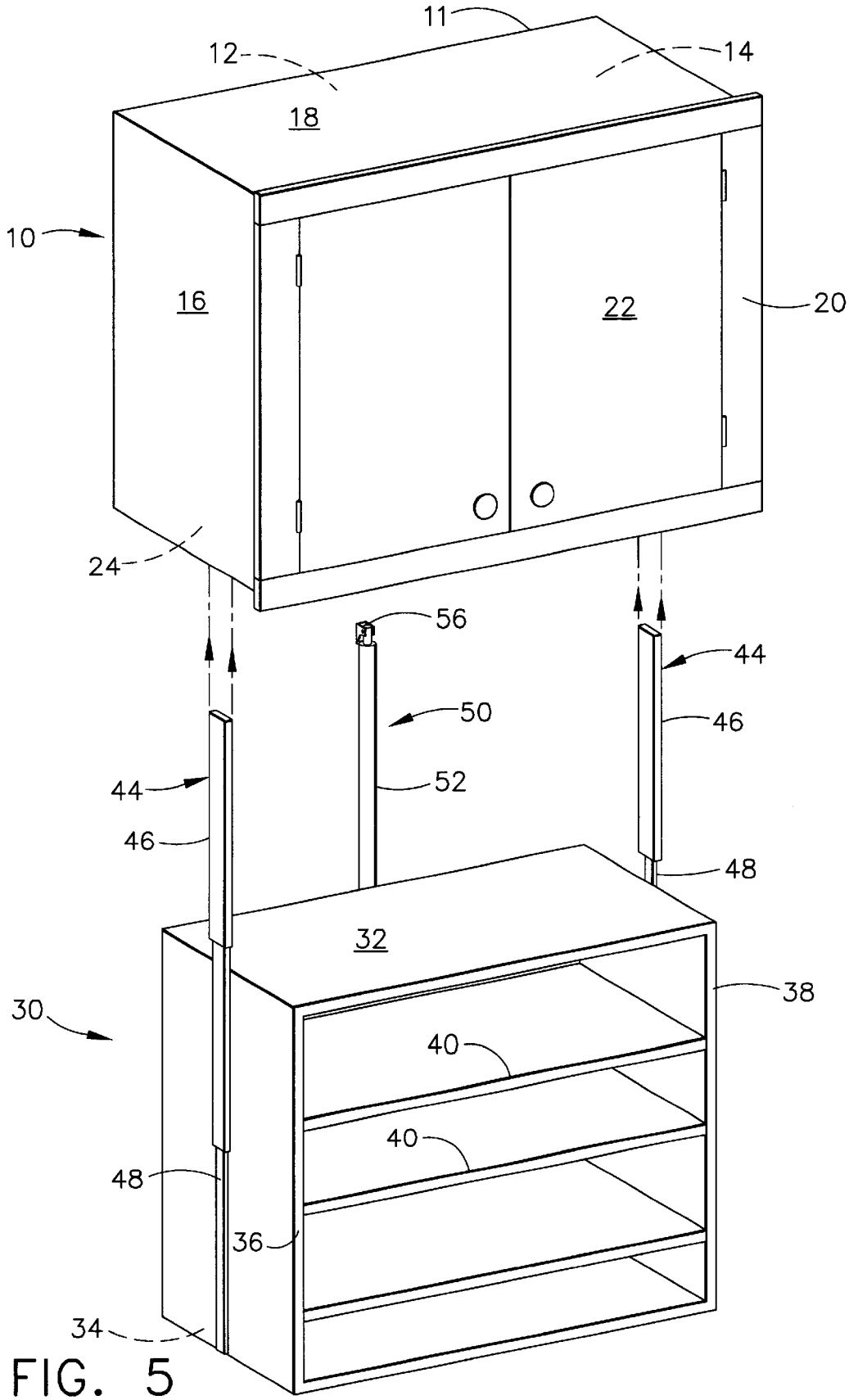
FIG. 5 is an exploded perspective view of a wall or ceiling mountable cabinet with downward extendable/retractable shelving assembly contemplated by the present invention.

Referring to the drawings, FIGS. 1, 2 and 5 show a cabinet generally denoted by reference numeral 10. The cabinet 10 has a housing 11 comprising a back panel 12, side panels 14 and 16, a top panel 18 and a front border referred to as a face frame 20 that defines an opening into the interior of the housing 11 This opening is covered by a door 22 that is hinged to the border 20. Alternatively, the door 22 can be replaced with a front panel. The bottom edges of the back panel 12, side panels 14 and 16 and the face frame 20 define a bottom opening 24.

Figure 3:
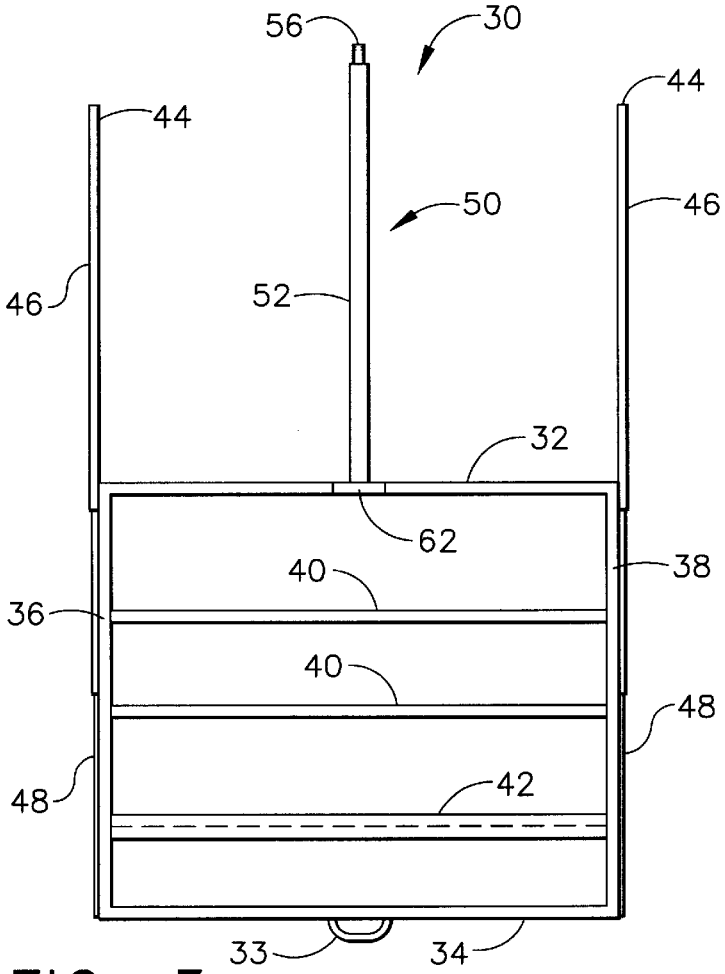
FIG. 3 is a front view of the shelving assembly of the cabinet of FIG. 1.
Figure 4:
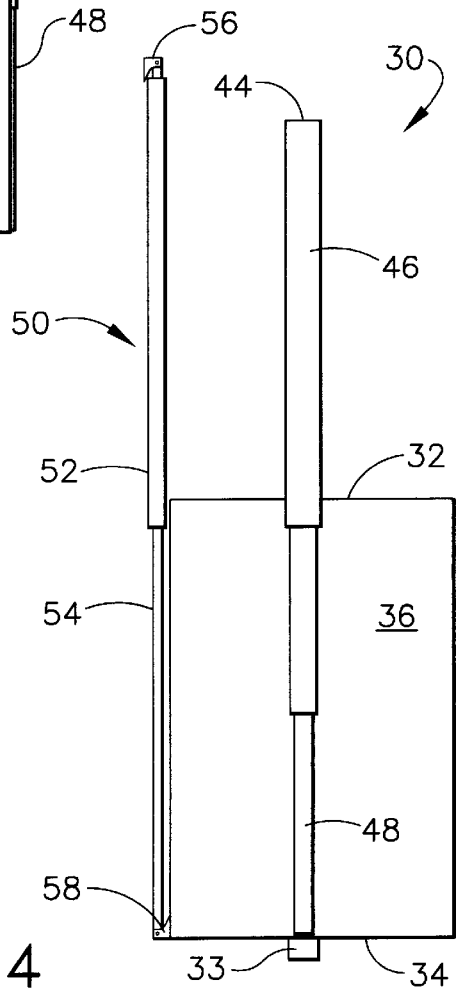
FIG. 4 a side view of the shelving assembly of FIG. 3.

Disposed in the interior of the housing 11 is a shelving assembly generally denoted by reference numeral 30. With reference to FIGS. 3, 4 and 5 the shelving assembly 30 comprises a top and bottom wall 32 and 34, side walls 36 and 38 and shelves 40. A handle 33 extends downward from the bottom wall 34.The position of the shelves 40 can be adjusted in a manner familiar to those skilled in the art. Optionally, the shelving assembly 30 may also have a back panel. Also, some of the shelves may have an upwardly extending lip 42 to keep items stored on the shelves from sliding off.

Conventional telescoping drawer glides 44 are used to couple the shelving assembly 30 to the housing 11. Each of the glides 44 has a first portion 46 that is mounted to one of the walls 14,16 and a second portion 48 that is mounted to one of the side walls 36, 38 respectively. In the preferred embodiment, a commercially available tension gas spring 50 has a cylinder 52 and a rod portion 54 that is mounted within the cylinder 52 and is extendable therefrom. The cylinder 52 is mounted to the back panel 12 by a pin and U-bracket 56 and the rod portion 54 is attached to the rear edge of the bottom wall 34 or the back panel by a pin and U-bracket 58 or other type of bracket such as a post style bracket or an eye rod end. A U-shaped guide 60, (see FIG. 7), is also mounted to the back panel 12 and is positioned to receive the cylinder 52 at an end opposite the end having the U-bracket 56. This U-shaped guide 60 provides lateral stability to the gas spring 50.

Figure 6:
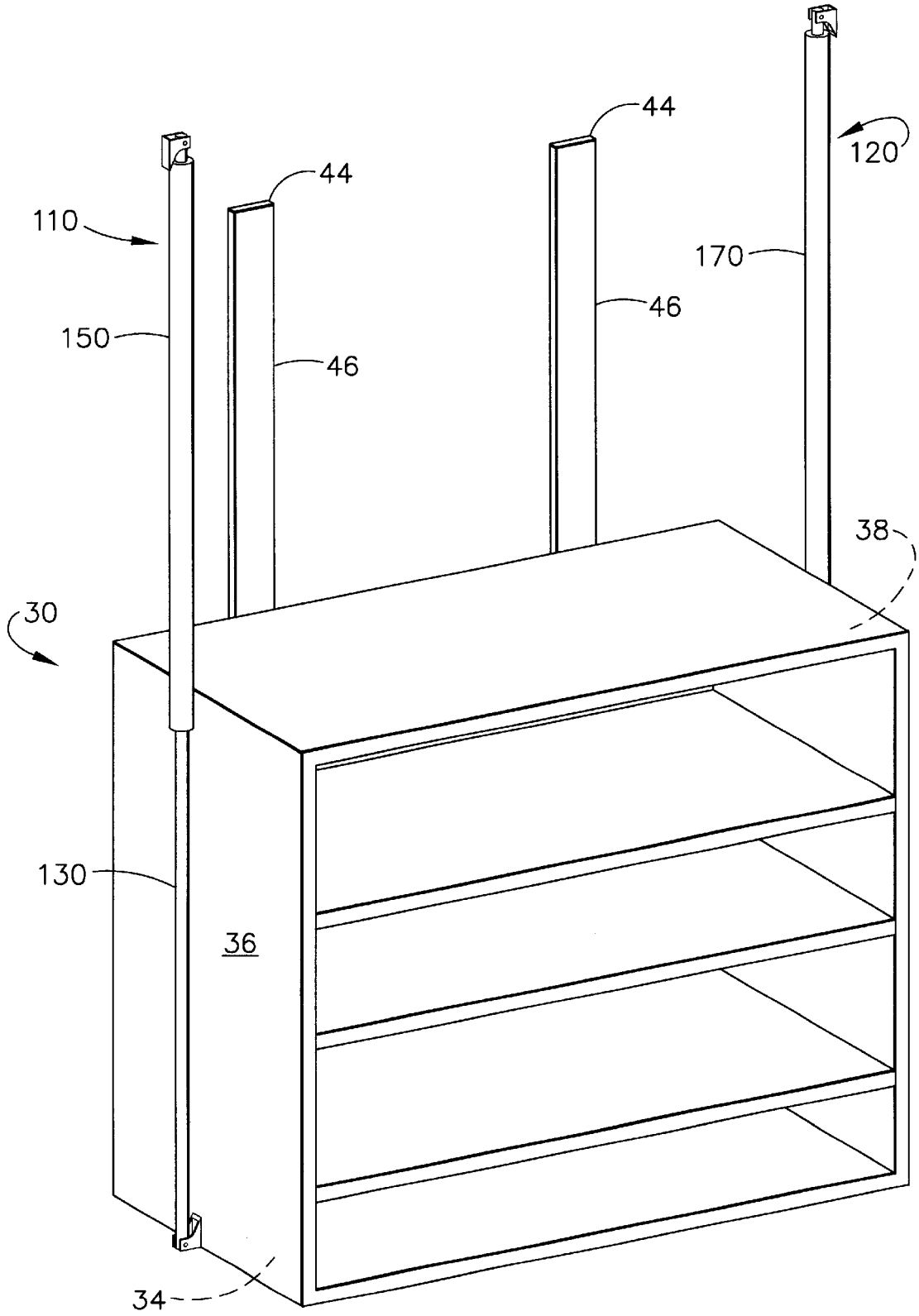
FIG. 6 is a perspective view of an alternative embodiment shelving assembly of the cabinet of FIG. 1.

In an alternative embodiment, as shown in FIG. 6, shelving assembly 30 employs two gas springs 110, 120 instead of one. In this embodiment, rod portion 130 of spring 110 is attached to side wall 36 or a side edge of bottom wall 34 proximal side wall 36 and the cylinder 150 of spring 110 is mounted to side panel 16, each in a manner similar to that described above. In similar fashion, rod portion (not shown) of spring 120 is attached to side wall 38 or a side edge of bottom wall 34 proximal side wall 38 and the cylinder 170 of spring 120 is mounted to side panel 14. First portions 46 of glides 44 are mounted to back panel 12 and second portions 48 are mounted to the rear edge of bottom wall 34 or the back panel, each in a manner similar to that described above. Such an arrangement prevents the shelving assembly 100 from twisting. In either embodiment, the point of attachment of the cylinder and rod portion of springs 50, 110, 120 can be reversed. That is, the cylinder can be attached to the bottom wall 34 and the rod portion to the top back panel 12 or side panels 14, 16.

Figure 7:
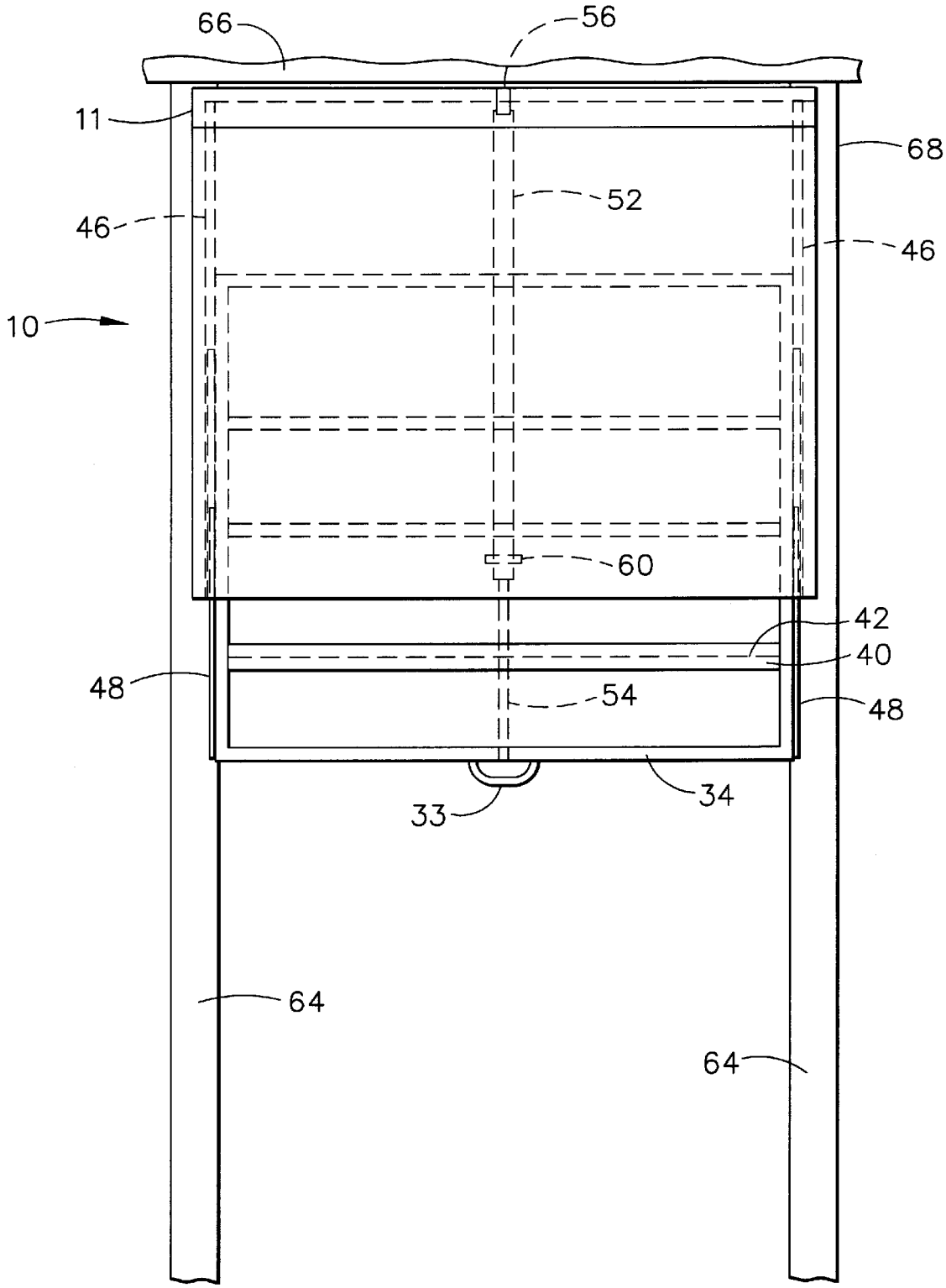
FIG. 7 is a front view of the cabinet of FIG. 1 mounted to a ceiling and showing the internal structure with dashed lines.

Referring to FIG. 7, the cabinet 10 is mounted to studs 64 in a wall just below a ceiling 66. A french cleat fastener 68 is the preferred method of mounting the cabinet to the wall.

Alternatively, the cabinet can be screwed into the studs. For aesthetic purposes, a cornice or molding, not shown, is disposed between the cabinet and the ceiling. When items are needed from the cabinet, the handle 33 is grasped and the shelves 40 are pulled down until the telescoping portions 48 of the glides 44 are fully extended. In this extended position, the shelves 40 are easily accessible. The shelves will stay fully extended, until by applying a light tap to the bottom wall 34 the tension spring 50 will cause the rod portion 54 to retract until all the shelves 40 are fully retracted back into the cabinet housing 11. To avoid accidental retraction caused by an inadvertent tap, a variety of latching devices can be used to hold the shelves 40 in their extended position. In the preferred embodiment, a magnet 62 (see FIG. 3) is mounted on the front edge of the top wall 32 and is positioned equidistant from walls 36 and 38. A corresponding magnet, (not shown), is mounted on the inside of the upper edge of the front border 20 and is positioned so that when the shelves 40 are fully extended downward, this magnet and magnet 62 form a magnetic latch. Thus, the shelves will not retract until a sufficient force is applied to break this magnetic latch.

Though the cabinet contemplated by the present invention has been described with respect to a rectangular shaped cabinet, it should be appreciated by one skilled in the art that the invention is equally applicable to other shapes such as triangular or square.

Various modifications and alterations to the above-described preferred embodiment will be apparent to those skilled in the art. Accordingly, these descriptions of the invention should be considered exemplary and not as limiting the scope and spirit of the invention as set forth in the following claims.

What is claimed is:

1. A cabinet for mounting to a wall or ceiling, said cabinet comprising:

a housing having an open bottom;

a shelving assembly disposed in said housing;

a self acting tension gas spring having a cylinder portion and a rod portion mounted in said cylinder portion and extendable therefrom, said cylinder portion attached to said housing by a first pin and U-bracket and said rod portion attached to said shelving assembly by a second pin and U-bracket, whereby said shelving assembly is extendable downward through said open bottom and retractable back into said housing; and a U-shaped guide attached to said housing and receiving said cylinder portion of said tension gas spring.

2. The cabinet of claim 1 wherein said shelving assembly comprises a top wall, a bottom wall, two sides walls disposed therebetween, and at least one shelf disposed between said side walls.

3. The cabinet of claim 2 wherein said shelf has an upward extending lip.

4. The cabinet of claim 2 wherein said shelving assembly further comprises at least one telescoping drawer guide.

5. The cabinet of claim 4 wherein said telescoping drawer guide has a first portion mounted to said housing and a second position mounted to said shelving assembly.

6. The cabinet of claim 1 wherein said housing comprises a back panel, two spaced apart side panels, a top panel, and a front border that defines an opening into the interior of said housing.

7. The cabinet of claim 6 wherein said opening is covered by a door.

8. The cabinet of claim 1 further comprising latching means for preventing inadvertent retraction of said shelving assembly.

9. A cabinet having downward extendable and retractable shelves, said cabinet comprising:

a housing mounted to a wall adjacent a ceiling, said housing having an open bottom;

a plurality of shelves disposed in said housing and attached thereto by at least two telescoping drawer guides;

a tension gas spring having a cylinder portion and a rod portion mounted in said cylinder portion and extendable therefrom, said cylinder portion attached to said housing by a first pin and U-bracket and said rod portion attached to said shelving assembly by a second pin and U-bracket;

a U-shaped guide attached to said housing and receiving said cylinder portion of said tension gas spring; and a handle attached to the lowest shelf, whereby the shelves are extendable downward through said open bottom by pulling on said handle and retractable back into said housing by tapping said handle.

10. The cabinet of claim 9 said housing is attached to said wall by a french cleat.

11. The cabinet of claim 9 wherein said housing is adapted to be attached to studs in said wall.

12. The cabinet of claim 11 wherein said cabinet is rectangular.

* * * * *